United States Patent [19]

Nunn, Jr. et al.

[11] Patent Number: 4,577,468

[45] Date of Patent: Mar. 25, 1986

[54] REFRIGERATION SYSTEM WITH REFRIGERANT PRE-COOLER

[76] Inventors: John O. Nunn, Jr., P.O. Box 397; John O. Nunn, Sr., 4414 Durant, No. 66, both of Deer Park, Tex. 77536

[21] Appl. No.: 688,727

[22] Filed: Jan. 4, 1985

[51] Int. Cl.[4] ..... F25B 41/00

[52] U.S. Cl. ..... 62/113; 62/117; 62/200; 62/513

[58] Field of Search ..... 62/113, 117, 197, 198, 62/199, 200, 513

[56] References Cited

U.S. PATENT DOCUMENTS

| | | | |
|---|---|---|---|
| 2,386,198 | 10/1945 | Dodson | 62/200 |
| 2,388,556 | 11/1945 | Lathrop | 62/200 |
| 2,797,554 | 7/1957 | Donovan | 62/513 |
| 2,871,679 | 2/1959 | Zearfoss, Jr. | 62/513 |
| 2,956,419 | 10/1960 | Boling | 62/513 |
| 3,064,449 | 11/1962 | Rigney | 62/513 |
| 3,082,610 | 3/1963 | Marlo | 62/509 |
| 3,214,929 | 11/1965 | Anderson | 62/197 |
| 3,446,032 | 5/1969 | Bottum | 62/513 |
| 3,473,348 | 10/1969 | Bottum | 62/513 |
| 3,602,004 | 8/1971 | Peavler | 62/197 |
| 3,851,494 | 12/1974 | Hess | 62/513 |
| 3,952,533 | 4/1976 | Johnston et al. | 62/513 |
| 4,357,805 | 11/1982 | Manning | 62/117 |
| 4,359,879 | 11/1982 | Wright | 62/513 |

*Primary Examiner*—Ronald C. Capossela

*Attorney, Agent, or Firm*—Neal J. Mosely

[57] ABSTRACT

A refrigeration system is disclosed having greatly improved efficiency. The system includes a pre-cooler heat exchanger for sub-cooling the liquid refrigerant from the condenser to render the entire evaporator more effective for refrigeration purposes. The heat exchanger for pre-cooling the liquid refrigerant has one passage through which the hot liquid refrigerant flows and another passage, in heat exchange relation therewith, which is connected to receive a small flow of liquid refrigerant bled off from the main stream of the liquid refrigerant which refrigerant passes through an expansion valve or capillary tube to vaporize so that the liquid refrigerant is sub-cooled by the latent heat of vaporization of the vaporizing refrigerant. This heat exchanger is located between the condenser and the receiver or between the condenser and the evaporator in systems not having a receiver. The flow of the vaporized refrigerant used for cooling in the heat exchanger may flow through a cooling tube in the receiver and is connected to the return flow of vaporized refrigerant flowing from the evaporator to the compressor.

20 Claims, 3 Drawing Figures

REFRIGERATION SYSTEM WITH REFRIGERANT PRE-COOLER

BACKGROUND OF THE INVENTION

1. Field of the Invention

This invention relates to new and improved refrigeration systems and more particularly to a system having a pre-cooler heat exchanger for sub-cooling the liquid refrigerant before entering into the evaporator.

2. Description of the Prior Art

It is well known in the art of refrigeration to improve efficiency by pre-cooling the liquid refrigerant flowing from the condenser to the receiver or flowing directly to the evaporator. Heat exchangers are employed in refrigeration systems for the exchange of heat between fluids, generally the cold refrigerant gases from the evaporator and warm liquid refrigerant from the condenser. The refrigerant gas which is exhausted from the evaporator of the refrigeration system is cold. The liquid refrigerant which is drawn from the condenser of a refrigeration system is warm. To improve the efficiency of the refrigeration system, it is desirable to heat exchange the warm liquid with the cold gas. The following patents illustrate the state of the art in pre-cooler technology:

Donovan U.S. Pat. No. 2,797,554 discloses a refrigeration apparatus including a heat interchanger which comprises, a shell construction having a central chamber, a pair of headers, and a partition separating the headers from the central chamber. Tube assemblies are rigidly mounted on the partition with ends opening into the headers to provide a passageway between the headers. Each tube assembly has its central portion contacting the corresponding portions of a plurality of the other tube assemblies to form the walls of fluid passageways extending longitudinally along the outer surfaces of the tube assemblies. Each tube assembly has ends of reduced cross-section spaced from the ends of the adjacent tube assemblies to provide a header zone in the shell at each end of the tube assemblies. Each tube assembly includes internal fins for heat exchange between fluids passing through the tube assemblies and through the central chamber shell externally of the tube assemblies. Means is provided to deliver a gas to one of the headers and to withdraw the gas from the other of the headers, and to deliver a liquid to one of the header zones at one end of the central chamber in the shell and to withdraw a liquid from the other of the header zones.

Boling, U.S. Pat. No. 2,956,419 discloses an arrangement for maintaining stable operation of refrigeration systems having air-cooled condenses throughout wide variations in the temperature of the cooling air. The invention also provides for maintaining stable operation of refrigeration systems having other types of condensers used with cooling towers.

Marlo U.S. Pat. No. 3,082,610 discloses that refrigerant flow controls, such as expansion valves, capillary tubes and the like, operate most efficiently when the fluctuation of the pressures at their inlet and outlet ports are not unduly great; and consequently that it is desirable to control the pressures at the inlet ports of refrigerant flow controls to keep those pressures from falling too low. Where the refrigerant flow controls are used in compression-expansion refrigeration systems, it is desirable to keep the liquid pressures in the receivers of those systems from falling to unduly low levels. With water-cooled condensers, it is easy to keep the liquid pressures in the receivers of those systems from falling too low; but with air-cooled condensers, it is not always easy to keep the liquid pressures in the receivers of those systems from falling too low. Consequently, it is desirable to keep the liquid pressure in the receiver of an air-cooled refrigeration system from falling to too low a level. A method and apparatus are disclosed for maintaining the liquid pressure in the receiver of an air-cooled refrigeration system above a predetermined minimum level.

Bottum U.S. Pat. No. 3,446,032 discloses a liquid-liquid heat exchanger comprising an outer casing and an inner, thermally-conductive casing, each having an inlet and an outlet for fluid. The inner casing may be fluted in the direction of fluid flow to increase the heat transfer surface and to assist in maintaining turbulent flow of refrigerant. A helical coil may be provided on the inner casing. A helically spiralled strip member may be provided within the inner casing.

Hess U.S. Pat. No. 3,851,494 discloses that excessive warming of the compressor input by the heat exchanger that supercools the condenser output may be prevented by a bypass switched in and out by a thermostatic control at the output of the compressor to prevent the final compression temperature from rising to a value at which damage to lubricating materials and flexible hose materials would result. A branching valve or a second expansion valve may be used according to whether the bypass is just around the heat exchanger or around both the heat exchanger and the evaporator.

Johnston U.S. Pat. No. 3,952,533 discloses an energy saving refrigeration system free of the usual winter head pressure controls on the condenser equipment, capable of functioning satisfactorily with two-phase, liquid-gas mixtures of refrigerant inlet flow, there being a pair of valves immediately upstream of the evaporator, one being an expansion valve, and the other being a pressure regulator just upstream of the expansion valve adjusted to maintain a fixed discharge pressure to the expansion valve, this regulator discharge pressure set sufficiently above the evaporator boiling pressure and set sufficiently below the minimum inlet pressure to the pressure regulator.

Wright U.S. Pat. No. 4,359,879 discloses a refrigeration system for cooling and drying hot, moist, compressed air by sub-cooling the liquid refrigerant from the condenser to eliminate all flash gas and render the entire evaporator effective for refrigeration purposes. The heat exchangers for the evaporator and for sub-cooling the liquid refrigerant are constructed of a one-piece finned copper inner cylinder with the routed fin enclosed inside an annular copper shell in which a 0.020-inch clearance exists between the annular copper shell and the fins to allow passage of a stream of air which causes the laminar flow around the routed fin construction to be agitated by eddy diffusion. The use of the novel heat exchanger in the refrigeration system along with the step of sub-cooling the liquid refrigerant is reported to produce a substantial gain in refrigeration without an increased requirement for either power or energy.

SUMMARY OF THE INVENTION

It is one object of this invention to provide a new and improved refrigeration system having greatly improved efficiency of operation.

Another object of the invention is to provide a refrigeration system with substantially increased refrigeration effect without an increase in the power or energy requirement.

Another object of the invention is to provide a refrigeration system in which the hot liquid refrigerant from the condenser is pre-cooled to render the entire evaporator effective for refrigeration.

Still another object of the invention is to provide a refrigeration system with a pre-cooler which utilizes the heat of vaporization of a portion of the liquid refrigerant to cool the remainder of the liquid.

Still another object of the invention is to provide refrigeration system having a pre-cooler heat exchanger with multiple passages in heat exchange relation connected so that a small part of the liquid refrigerant is expanded and vaporized into one passage to cool the main body of liquid which is flowing through the other passage.

Yet another object of the invention is to provide refrigeration system having a pre-cooler heat exchanger with multiple passages in heat exchange relation connected so that a small part of the liquid refrigerant is expanded and vaporized into one passage to cool the main body of liquid which is flowing through the other passage, the vaporized refrigerant being connected to join the vaporized refrigerant flowing from the evaporator back to the compressor.

Yet another object of the invention is to provide refrigeration system having a pre-cooler heat exchanger with multiple passages in heat exchange relation connected so that a small part of the liquid refrigerant is expanded and vaporized into one passage to cool the main body of liquid which is flowing through the other passage, and in which the refrigerant used in cooling the liquid is also connected through a cooling tube in the receiver to further cool the liquid therein.

Yet another object of the invention is to provide refrigeration system having a pre-cooler heat exchanger with multiple passages in heat exchange relation connected so that a small part of the liquid refrigerant is expanded and vaporized into one passage to cool the main body of liquid which is flowing through the other passage, and in which the refrigerant used in cooling the liquid is also connected through a cooling tube in the receiver to further cool the liquid therein, the vaporized refrigerant being connected to join the vaporized refrigerant flowing from the evaporator back to the compressor.

Other objects of the invention will become apparent from the specification and claims as hereinafter related.

The above stated objects and other objects of the invention are accomplished by sub-cooling or precooling the liquid refrigerant from the condenser prior to expansion and the cooling of the work fluid in the evaporator. The sub-cooling of the liquid refrigerant aids in maintaining the refrigerant liquid throughout the evaporator, thus rendering the entire evaporator effective for refrigeration. The system includes a pre-cooler heat exchanger which has one passage through which the hot liquid refrigerant flows and another passage, in heat exchange relation therewith, which is connected to receive a small flow of liquid refrigerant bled off from the main stream of the liquid refrigerant which refrigerant passes through an expansion valve or capillary tube to vaporize so that the liquid refrigerant is sub-cooled by means of the latent heat of vaporization of the vaporizing refrigerant. This heat exchanger is located between the condenser and the receiver or between the condenser and the evaporator in systems not having a receiver. The flow of the vaporized refrigerant used for cooling in the heat exchanger may flow through a cooling tube in the receiver and is connected to the return flow of vaporized refrigerant flowing from the evaporator to the compressor.

DESCRIPTION OF THE PREFERRED EMBODIMENTS

FIRST EMBODIMENT—REFRIGERATION SYSTEM WITHOUT RECEIVER

Figure 1:
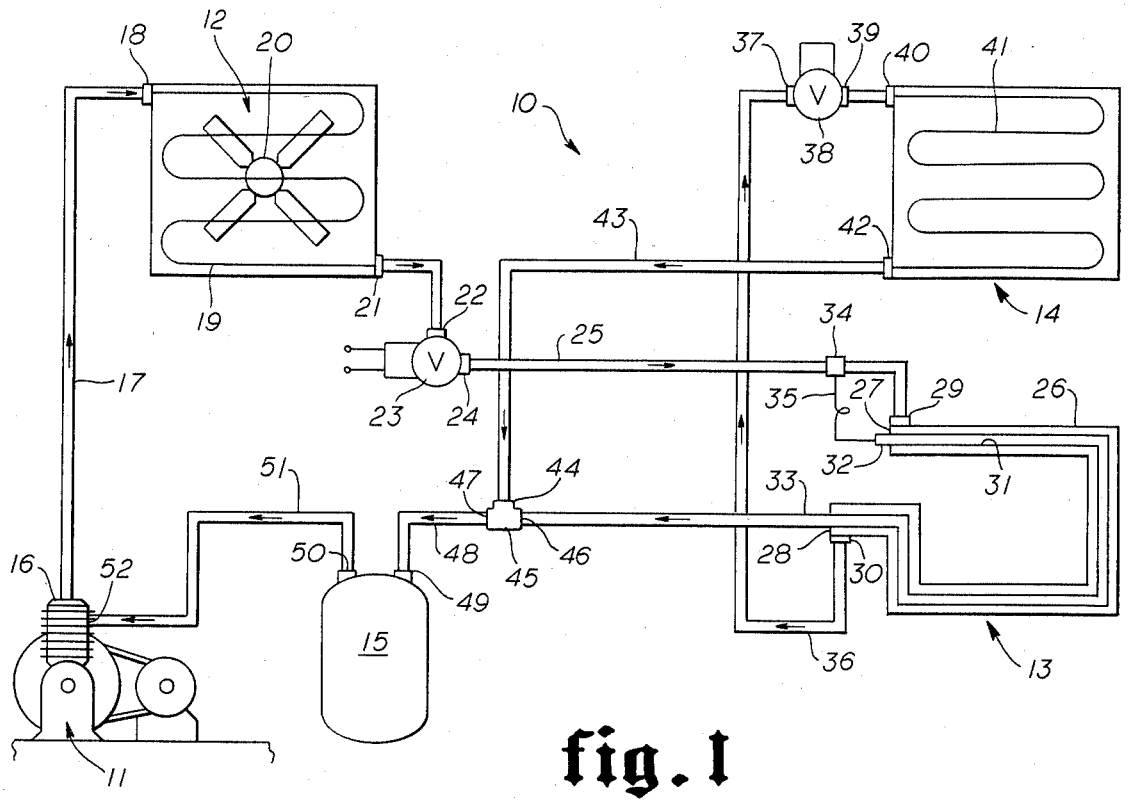
FIG. 1 is a schematic view of a preferred embodiment of this invention comprising an improved refrigeration system having a pre-cooler heat exchanger connected to sub-cool the liquid refrigerant by expansion of a portion of the refrigerant in parallel with the evaporator.

Referring to the drawings by numerals of reference, and more particularly to FIG. 1, there is shown a refrigeration system 10 which may be used for commercial or industrial refrigeration or may provide the cooling for an air conditioning system. Refrigeration system 10 comprises compressor 11, condenser 12, pre-cooler heat exchanger 13, evaporator 14, and suction line accumulator 15.

The refrigeration system is connected with various components arranged in series, with various control elements being in place as indicated below. The outlet 16 from compressor 11 is connected to tubing 17 which leads to the inlet 18 of heat exchange tubing 19 in condenser 12. Condenser 12 also has a fan 20 to circulates air past the heat exchange tubing 19 for removal of heat therefrom. The outlet 21 from heat exchange tubing 19 is connected to one side 22 of solenoid control valve 23. The outlet 24 from solenoid valve 23 is connected to tubing 25 leading to the pre-cooler or heat exchanger 13 for subcooling liquid refrigerant.

Heat exchanger 13 is a direct-expansion liquid refrigerant heat exchanger specially designed to pre-cool the hot liquid refrigerant flowing from condenser 12. Heat exchanger 13 comprises an outer shell or tubing 26 with closed ends 27 and 28 and an inlet 29 at one end and outlet 30 at the other end. An inner shell or tubing 31 extends through the end closures 27 and 28, through the entire length of the outer shell 26, and has an inlet opening 32 at one end and outlet opening 33 at the other end. This heat exchanger can be shaped in a variety of ways, such as being coiled, squared, etc. One form of the heat exchanger which has been tested had a $1\frac{1}{8}$ in. copper tubing as the outer shell with a ¾ in. copper tubing forming the inner shell.

The tubing 25 from the outlet 24 of solenoid control valve 23 is connected to the inlet 29 to the outer shell 26 of the heat exchanger 13. A fitting 34 in tubing line 25 includes an expansion device for bleeding off a small amount of the liquid refrigerant and allowing it to expand and evaporate at a selected and controlled rate. The expansion device as shown is a simple capillary tube 35 of the type used in small capacity refrigeration systems. Of course, the conventional refrigeration expansion valve could be used in this location if desired, particularly in higher capacity systems.

Capillary tube 35 opens into the inlet opening 32 of inner shell 31 and permits a small amount of liquid refrigerant to expand into and evaporate in the inner shell 31 to provide a substantial cooling of the liquid refrigerant passing through outer shell 26. The expansion of liquid refrigerant and evaporation into inner shell 31 utilizes the latent heat of vaporization of the refrigerant instead of the sensible heat of evaporated refrigerant gas, as in prior art pre-coolers.

Outlet 30 from outer shell 26 is connected to tubing 36 leading to the inlet side 37 of refrigeration expansion valve 38. The outlet side 39 of expansion valve 38 is connected to the inlet end 40 of the heat exchange coil or evaporator coil 41 of the evaporator unit 14. Evaporator coil 41 provides the cooling for a commercial or industrial size refrigeration unit or for cooling air in an air conditioning system. The outlet 42 of evaporator coil 41 is connected to tubing 43 which extends to one inlet 44 of a tee fitting 45. Another inlet 46 of tee fitting 45 is connected to tubing 47 leading from the outlet 33 of the inner shell 31 of heat exchanger or pre-cooler 13. The outlet 47 from tee fitting 45 is connected to tubing 48 leading to the inlet 49 of suction line accumulator 15. The outlet 50 from suction line accumulator 15 is connected to tubing 51 which extends to the inlet 52 at the suction side of compressor 11.

A SECOND EMBODIMENT—SYSTEM HAVING LIQUID RECEIVER

Figure 2:
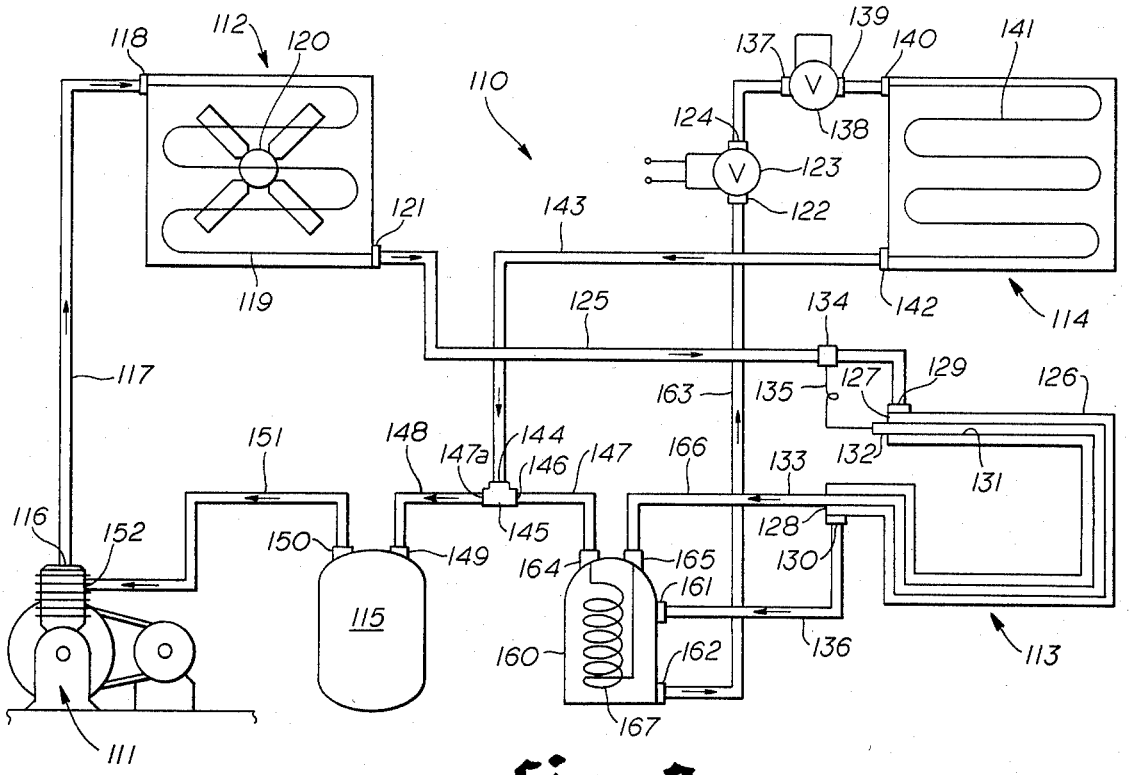
FIG. 2 is a schematic view of another embodiment of this invention comprising an improved refrigeration system having a pre-cooler heat exchanger connected to sub-cool the liquid refrigerant by expansion of a portion of the refrigerant in parallel with the evaporator wherein the refrigerant used in cooling the liquid refrigerant is passed through the receiver to further cool the liquid therein.

In FIG. 2, there is shown another embodiment of the refrigeration system shown in FIG. 1 wherein the system is provided with a receiver for liquid refrigerant and an additional heat exchange coil for further cooling the liquid refrigerant flowing from the pre-cooler heat exchanger. Components which are the same as in FIG. 1 are given the same reference numerals increased by one hundred. The refrigeration system 110 has a compressor 111, condenser 112, pre-cooler heat exchanger 113, evaporator 114, suction line accumulator 115 and a liquid receiver 160.

Compressor 111 has its outlet 116 connected to tubing 117 leading to the inlet 118 of heat exchange coil 119 in condenser 112. Condenser fan 120 circulates cooling air over the heat exchange coil 119 to remove heat from the refrigerant condensing therein. Outlet 121 from condenser 112 is connected to tubing 125 extending to heat exchanger or pre-cooler 113.

Heat exchanger or pre-cooler 113 consists of an outer shell 126 with closed ends 127 and 128 at opposite ends thereof. Tubing 125 is connected into inlet 129 in outer shell 126. Outlet 130 from outer shell 126 is connected to a receiver to be subsequently described. Heat exchanger or pre-cooler 113 has an inner shell or tubing 131 which extends through end walls or closures 127 and 128. Inner shell 131 has an inlet opening 132 and outlet opening 133.

A fitting 134 in line 125 includes an expansion device comprising a refrigerant capillary tube 135 opening into inlet opening 132 to inner tubing or shell 131. Capillary 135 performs the function of allowing a controlled expansion and vaporization of a small amount of liquid refrigerant at a selected rate to use the latent heat of vaporization of the refrigerant in inner shell 131 for cooling the hot liquid refrigerant flowing through the outer shell 126.

Tubing 136 extends from the outlet 130 of outer shell 126 to the inlet 161 of liquid receiver 160. The outlet 162 of receiver 160 is connected to tubing 163 which extends to the inlet side 122 of flow control solenoid valve 123. The outlet side 124 of solenoid valve 123 is connected to the inlet side 137 of refrigeration expansion valve 138. The outlet side 139 of expansion valve 138 is connected to inlet 140 of evaporator heat exchange coil 141.

The outlet 142 of evaporator coil 141 is connected to tubing 143 which extends to one of the inlets 144 from the tee connection 145. Another inlet 146 of tee connection 145 is connected by tubing 147 to an outlet 164 in the shell of liquid receiver 160. The outlet 147a of tee connection 145 is connected to tubing 148 connected to inlet 149 of suction line accumulator 115. The outlet 150 from accumulator 115 is connected to tubing 151 which is connected back to the suction line inlet 152 of compressor 111. Inlet 165 on receiver 162 is connected by line 166 to outlet 133 from inner shell 131 of pre-cooler heat exchanger 113. A heat exchange coil 167 is connected between inlet 165 and outlet 164 on the shell of liquid receiver 160 and conducts vaporized refrigerant therethrough in heat exchange relation to cool further the liquid refrigerant collected in receiver 160.

A THIRD EMBODIMENT—SYSTEM HAVING COOLED RECEIVER

Figure 3:
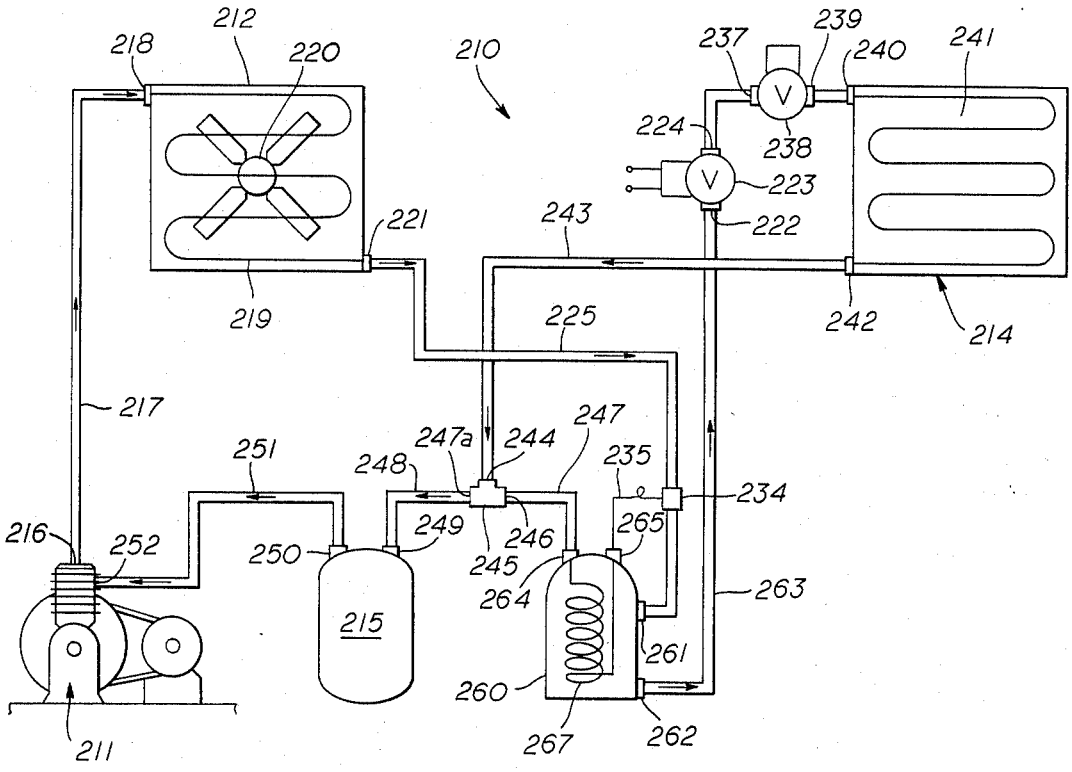
FIG. 3 is a schematic view of still another embodiment of this invention comprising an improved refrigeration system having a pre-cooler direct expansion heat exchanger positioned in the liquid receiver to pre-cool the liquid refrigerant therein by expansion of a portion of the refrigerant in parallel with the evaporator.

In FIG. 3, there is shown another embodiment of the refrigeration system shown in FIG. 1 wherein the system is provided with a receiver for liquid refrigerant and a direct expansion heat exchange coil for cooling the liquid refrigerant therein instead of the flow line heat exchanger used in the embodiments of FIGS. 1 and 2. Components which are the same as in FIG. 1 are given the same reference numerals increased by two hundred.

The refrigeration system 210 has a compressor 211, condenser 212, evaporator 214, suction line accumulator 215 and a liquid receiver 260 with a direct expansion heat exchange coil 267 therein. Compressor 211 has its outlet 216 connected to tubing 217 leading to the inlet 218 of heat exchange coil 219 in condenser 212. Condenser fan 220 circulates cooling air over the heat exchange coil 219 to remove heat from the refrigerant condensing therein. Outlet 221 from condenser 212 is connected to tubing 225 extending to liquid receiver 260.

Inlet 265 on receiver 260 is connected to one end of heat exchange coil 267, the other end of which is connected to outlet 264. A fitting 234 in line 225 includes an expansion device comprising a refrigerant capillary tube 235 opening into inlet opening 265 to heat exchange coil 267. Capillary 235 performs the function of allowing a controlled expansion and vaporization of a small amount of liquid refrigerant at a selected rate to use the latent heat of vaporization of the refrigerant in heat exchange coil 267 for cooling the hot liquid refrigerant in the receiver 260. In larger systems, an expansion valve may be used in place of capillary 235. In this embodiment, the expansion of a small amount of liquid refrigerant into coil 267 provides the cooling which was provided by the pre-cooler heat exchanger 13 or 213 in the embodiments shown in FIGS. 1 and 2.

Tubing 263 extends from the outlet 262 of liquid receiver 260 to the inlet side 222 of flow control solenoid valve 223. The outlet side 224 of solenoid valve 223 is connected to the inlet side 237 of refrigeration expansion valve 238. The outlet side 239 of expansion valve 238 is connected to inlet 240 of evaporator heat exchange coil 241.

The outlet 242 of evaporator coil 241 is connected to tubing 243 which extends to one of the inlets 244 on the tee connection 245. Another inlet 246 of tee connection 245 is connected by tubing 247 to outlet 264 from heat exchange coil 267 in liquid receiver 260. The outlet 247[a] of tee connection 245 is connected to tubing 248 connected to inlet 249 of suction line accumulator 215. The outlet 250 from accumulator 215 is connected to tubing 251 which is connected back to the suction line inlet 252 of compressor 211.

GENERAL OPERATION

The condenser 13 or 113 performs its normal function of removing the heat picked up in the evaporator 14 or 114 which is carried to the compressor 11 or 111 in the suction line gas. The compressor 11 or 111, in turn, compresses the refrigerant gas which results in a large increase in both pressure and temperature of the gas before it enters the condenser coils 19 or 119.

As this high-pressure, high-temperature gas flows through the condenser coils 19 or 119, the heat picked up in the evaporator is given off into the air passing over the condenser coils and the refrigerant condenses. Whenever the ambient temperature around the condenser 12 or 112 increases, the refrigerant in the condenser has less and less heat removed and the condensed liquid refrigerant leaving the condenser increases substantially in both pressure and temperature. As the temperature of the liquid refrigerant increases, the compressor draws more and more wattage.

The cool suction gas from the evaporator 14 or 114 cools the compressor somewhat. However, as the pressure and temperature in the condenser 12 or 112 rises with increase in ambient heat, the compressor 11 or 111 does not receive enough cooling from the suction gas to offset this rise in ambient temperature, thus causing an increase in wattage consumed. The industry has attempted to correct this by building larger condensing units and also by using liquid line heat exchangers, using suction gas to cool the liquid refrigerant (as described above in the description of the prior art). This has helped but has not solved the problem.

In the embodiments described above, the refrigeration system has been modified by addition of a direct expansion liquid refrigerant heat exchanger, or subcooler 13 or 113 or receiver cooling coil 267. This device supplies cool liquid refrigerant from the condenser 12 or 112 to the metering device or expansion valve 38 or 138 at the evaporator 14 or 114 and further maintains a cool suction gas to the compressor to facilitate the cooling of the compressor. This greatly reduces the wattage usage of the condenser.

The hot liquid leaving the condenser coils 19 or 119 coils passes through the outer shell 26 or 126 which is designed to be of equal overall size as the copper tubing 25 or 125 leaving the condenser 12 or 112. This liquid line 25 or 125 has a metering device, i.e., capillary 35 or 135, tapped into the inner shell to provide a predetermined amount of liquid refrigerant to the inner shell 31 or 131 for cooling.

The expansion of this liquid refrigerant entering the inner shell 31 or 131 cools the liquid refrigerant in the outer shell 26 or 126 to a temperature of from 40° to 65° depending on the amount of cooling of the liquid refrigerant desired. In the embodiment shown in FIG. 3, the heat exchanger 13 or 113 is eliminated and the heat exchange coil 267 in liquid receiver 260 performs the function of pre-cooling the liquid refrigerant before it reaches the evaporator.

This cool expanded refrigerant gas leaving the inner shell 31 or 131 of the heat exchanger 13 or 113 is then connected to the suction line from the evaporator just before the line enters the liquid receiver, which further cools the suction refrigerant before it enters the compressor which furnishes more cooling to the compressor. This results in reducing the wattage draw for the condenser.

The cool liquid refrigerant leaving the outer shell 26 or 126 flows to the expansion valve 38 in the evaporator and the expansion of this colder liquid refrigerant in the evaporator tubes results in a colder evaporator, causing a larger temperature spread across the evaporator coils. This increase in the temperature spread across the evaporator coils increases the B.T.U. efficiency of the unit while reducing the wattage consumption. In the second embodiment of the system, the cooled liquid refrigerant passes into a liquid receiver 160 and thence to the expansion valve at the evaporator. The cold expanded refrigerant from inner shell 31 or 131 then passes through a cooling coil 167 in receiver 160 to further cool the liquid.

In each of the embodiments of the system, a new approach is used to improving the efficiency of refrigeration and air conditioning systems. The principle used as a basic requirement is a sub-cooled refrigerant leaving the condenser which will lower the temperature of the liquid refrigerant entering the expansion valve. As a result, the flash-gas entering the evaporator will be considerably colder, resulting in a much larger temperature spread between the air entering the coil and the temperature of the air leaving the evaporator coil. Our tests show a superheat across the coil of 12° with a temperature difference of 21°.

This system operates normally on a suction pressure of 75 psig. and a liquid line pressure of 190 to 225 psig. The condenser 12 or 112 draws 8.2 to 8.6 amps under full load conditions and uses 1992 watts. This produces up to 50,400 BTU of air conditioning, resulting in a normal EER rating of up to 25.4 EER. The BTU output is determined by taking the wet-bulb temperatures of the air entering and leaving the conditioned area. These two readings are then plotted on an enthalpy deviation scale shown on a Psychrometric chart.

The difference in the two readings is first multiplied by the C.F.M. supply from the evaporator unit to the conditioned area and then multiplied by a factor of 4.5 to obtain the B.T.U. output of the unit. The 4.5 factor used is obtained from the Mechanical Equipment Service Manual for steamfitter-pipefitter journeymen and apprentices published by the "NATIONAL JOINT STEAMFITTER-PIPEFITTER APPRENTICESHIP COMMITTEE" composed of representatives of the Mechanical Contractors Assn. of America, Inc., and the United Association of Journeymen and Apprentices of the Plumbing and Pipe-fitting Industry of the United States and Canada. On page 4 of the manual, under the section "Heating and Cooling Capacity of Air", the formula is explained resulting with the factor of 4.5 "BTUH=4.5×CFM×(H1-H2). H1 represents enthalpy (Total Heat) of the entering air, B.T.U. per lb. H2 represents enthalpy (Total heat) of leaving air, B.T.U. per lb.

The operating principle of this unit is to reduce the temperature of the liquid refrigerant being supplied to the evaporator coil. By reducing the temperature of the liquid refrigerant, a much colder evaporator coil is obtained as well as reducing the head pressure on the compressor, all of which results in a lower wattage draw on the unit. The use of the direct expansion heat exchanger or sub-cooler 13 or 113 effectively establishes a second evaporator in parallel with the main evaporator 14 or 114 and utilizes the latent heat of vaporization of the liquid to cool the hot refrigerant liquid. As previously noted, the prior art has tried pre-cooling the liquid refrigerant with the suction line gas but the amount of available cooling is miniscule in comparison with the cooling effected by the direct expansion heat exchanger 13 or 113.

While this invention has been described fully and completely with special interest on three preferred embodiments, it should be understood that, within the scope of the appended claims, the invention may be practiced otherwise than as specifically described herein.

We claim:

1. A refrigeration system comprising a compressor, a condenser, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, further including heat exchange means positioned between the outlet from said condenser and the inlet to said evaporator to pre-cool the liquid refrigerant flowing therebetween by vaporization of part of the liquid refrigerant before said refrigerant reaches said evaporator, said heat exchange means comprising a heat exchanger having two flow passages one inside the other, each having an inlet and an outlet, and in heat exchange relation one with the other, the outer one of said heat exchange flow passages being connected between said condenser and said evaporator in series therewith to conduct the main body of liquid refrigerant flowing therebetween surrounding said inner flow passage, and the inner one of said heat exchange flow passages being connected to receive a small portion of said liquid refrigerant and permit the same to evaporate to cool the main body of liquid refrigerant flowing through said outer surrounding flow passage.

2. A refrigeration system according to claim 1 further including expansion means connected at the inlet end of said inner heat exchange flow passage to receive liquid refrigerant from said condenser and effect the vaporization thereof into said inner flow passage for cooling said main body of liquid refrigerant flowing through the outer, surrounding flow passage.

3. A refrigeration system according to claim 2 in which said expansion means comprises a capillary tube.

4. A refrigeration system according to claim 1 in which the outlet end of said outer heat exchange flow passage is connected to the inlet end of said evaporator, and the outlet end of said inner heat exchange flow passage is connected to the inlet to said compressor.

5. A refrigeration system according to claim 1 further including expansion means connected at the inlet end of said inner heat exchange flow passage to receive liquid refrigerant from said condenser and effect the vaporization thereof into said inner flow passage for cooling said main body of liquid refrigerant, and in which the outlet end of said outer heat exchange flow passage is connected to the inlet end of said evaporator, and the outlet end of said inner heat exchange flow passage is connected to the inlet to said compressor.

6. A refrigeration system according to claim 1 further including a suction line accumulator connected in series between the outlet end of said evaporator and the inlet side of said compressor.

7. A refrigeration system according to claim 6 in which the outlet end of said outer heat exchange flow passage is connected to the inlet end of said evaporator, and the outlet end of said inner heat exchange flow passage is connected to the inlet to said suction line accumulator.

8. A refrigeration system according to claim 6 further including expansion means connected at the inlet end of said outer heat exchange flow passage to receive liquid refrigerant from said condenser and effect the vaporization thereof into said inner flow passage for cooling said main body of liquid refrigerant in said surrounding outer flow passage.

9. A refrigeration system according to claim 8 in which said expansion means comprises a capillary tube.

10. A refrigeration system according to claim 1 further including a receiver for liquid refrigerant positioned in series between the outlet from said condenser and the inlet to said evaporator, said heat exchange means being positioned between the outlet from said condenser and the inlet to said liquid receiver to pre-cool the liquid refrigerant flowing therebetween by vaporization of part of the liquid refrigerant before said refrigerant reaches said evaporator, said heat exchange means comprising a heat exchanger having two flow passages one inside the other, each having an inlet and an outlet, and in heat exchange relation one with the other, the outer one of said heat exchange flow passages being connected between said condenser and said receiver in series therewith to conduct the main body of liquid refrigerant flowing therebetween surrounding said inner flow passage, and the inner one of said heat exchange flow passages being connected to receive a small portion of said liquid refrigerant and permit the same to evaporate to cool the main body of liquid refrigerant flowing through said outer surrounding flow passage.

11. A refrigeration system according to claim 10 in which said receiver has an inlet connected to the outlet from said outer flow passage and an outlet connected to the inlet to said evaporator, a heat exchange tube positioned in said liquid receiver, to be surrounded by liquid refrigerant therein, having an inlet connected to the outlet from said inner flow passage and an outlet connected to the inlet to said compressor.

12. A refrigeration system according to claim 10 further including expansion means connected at the inlet end of said inner heat exchange flow passage to receive liquid refrigerant from said condenser and effect the vaporization thereof into said inner flow passage for cooling said main body of liquid refrigerant in said surrounding outer flow passage.

13. A refrigeration system according to claim 12 in which said expansion means comprises a capillary tube.

14. A refrigeration system according to claim 10 further including a suction line accumulator connected in series between the outlet end of said evaporator and the inlet side of said compressor.

15. A refrigeration system according to claim 14 in which the outlet end of said outer heat exchange flow passage is connected to the inlet end of said evaporator, and the outlet end of said inner heat exchange flow passage is connected to the inlet to said suction line accumulator.

16. A refrigeration system according to claim 14 in which said receiver has an inlet connected to the outlet from said outer flow passage and an outlet connected to the inlet to said evaporator, a heat exchange tube is positioned in said liquid receiver having an inlet connected to the outlet from said inner flow passage and an outlet connected to the inlet to said suction line accumulator.

17. A refrigeration system according to claim 16 further including expansion means connected at the inlet end of said inner heat exchange flow passage to receive liquid refrigerant from said condenser and effect the vaporization thereof into said inner flow passage for cooling said main body of liquid refrigerant in said surrounding outer flow passage.

18. A refrigeration system according to claim 17 in which said expansion means comprises a capillary tube.

19. A refrigeration system according to claim 1 further including a receiver for liquid refrigerant positioned in series between the outlet from said condenser and the inlet to said evaporator, said inner flow passage comprising a tubing positioned in said receiver at a location to be surrounded by liquid refrigerant for heat exchange therewith having an inlet at one end and an outlet at the other end communicating with the inlet to said compressor, said outer flow passage comprising said receiver, and expansion means connected at the inlet end of said tubing in said receiver to receive liquid refrigerant from said condenser and effect the vaporization thereof into said tubing for cooling the liquid refrigerant in said receiver.

20. In a method of refrigeration in which a refrigerant gas is compressed, then condensed to a hot liquid refrigerant and finally expanded at a selected rate to evaporate and thereby effect refrigerant cooling, the improvement which comprises cooling the main body of liquid refrigerant by evaporation of a small portion of said liquid before the expansion and evaporation of the main body of said liquid at said selected rate, said evaporation of said small portion of liquid refrigerant is carried out by passing the same through an inner passage in heat exchange with a main body of liquid in a surrounding outer passage.

* * * * *